US005090062A

United States Patent [19]

Hochstrasser

[11] Patent Number: 5,090,062

[45] Date of Patent: Feb. 25, 1992

[54] SANITARY FITTING

[75] Inventor: Ferdinand Hochstrasser, Auenstein, Switzerland

[73] Assignee: KWC AG, Unterkulm, Switzerland

[21] Appl. No.: 627,195

[22] Filed: Dec. 13, 1990

[30] Foreign Application Priority Data

Dec. 13, 1989 [CH] Switzerland ..... 04481/89

[51] Int. Cl.[5] ..... E03C 1/04; F16K 21/00

[52] U.S. Cl. ..... 4/192; 137/801; 4/195

[58] Field of Search ..... 4/191, 192, 654, 195; 137/216, 217, 218, 801

[56] References Cited

U.S. PATENT DOCUMENTS

| | | | |
|---|---|---|---|
| 3,818,929 | 6/1974 | Braukmann | 137/218 |
| 3,862,640 | 1/1975 | Hechler | 137/218 X |
| 4,013,089 | 3/1977 | Braukmann | 137/218 |
| 4,103,709 | 8/1978 | Fischer | 137/801 |
| 4,827,538 | 5/1989 | Heimann et al. | 4/191 |
| 4,977,920 | 12/1990 | Oberdorfer | 137/218 |
| 5,009,247 | 4/1991 | Oberdorfer | 137/218 |
| 5,014,749 | 5/1991 | Humpert et al. | 4/192 |

FOREIGN PATENT DOCUMENTS

| | | | |
|---|---|---|---|
| 0012890 | 7/1980 | European Pat. Off. . | |
| 0304529 | 3/1989 | European Pat. Off. | 4/191 |
| 0390248 | 10/1990 | European Pat. Off. | 4/191 |
| 3509649 | 9/1986 | Fed. Rep. of Germany | 4/191 |
| 3513840 | 10/1986 | Fed. Rep. of Germany | 4/192 |
| 3531935 | 3/1987 | Fed. Rep. of Germany | 4/191 |
| 3726436 | 2/1988 | Fed. Rep. of Germany | 4/191 |
| 8716239 | 3/1988 | Fed. Rep. of Germany . | |
| 8813390 | 2/1989 | Fed. Rep. of Germany . | |
| 3822872 | 1/1990 | Fed. Rep. of Germany | 4/192 |
| 2500564 | 8/1982 | France | 4/192 |
| 651119 | 8/1985 | Switzerland . | |
| 654088 | 1/1986 | Switzerland . | |
| 2186059 | 8/1987 | United Kingdom . | |

OTHER PUBLICATIONS

DIN 3266; Armaturen fur Trinkwasser Installationen in Grundstucken und Gebauden; Jul. 1986.

Din, 1988; Technische Regein fur Trinkwasser-Installationen, Dec. 1988.

*Primary Examiner*—William A. Cuchlinski, Jr.

*Assistant Examiner*—John L. Beres

*Attorney, Agent, or Firm*—Oblon, Spivak, McClelland, Maier & Neustadt

[57] ABSTRACT

A sanitary fitting includes a fitting housing which has a fixed housing part which is overlapped by a jacket element which can be swivelled about an axis. Projecting toward the front from the jacket element is a nozzle in which a guide bush is inserted. Together with the inner wall of the nozzle, the guide bush bounds a jacket space which is connected to the surroundings by a passage. Furthermore, the jacket space is communicated by an aeration passage to an annular channel which is communicated by an aeration line to an aeration aperture of a safeguard mechanism. Water fed through a feed line is mixed in a control cartridge and flows through the safeguard mechanism, connected downstream from the control cartridge, and through a pipe into a hose to a shower. In the case of conditions permitting backflow of water into the feed line, the safeguard mechanism prevents backflow and aerates the pipe and the hose while exposing an aeration aperture. Any water thereby escaping through the aeration aperture is conducted through an aeration channel into a deeper part of a sink.

12 Claims, 1 Drawing Sheet

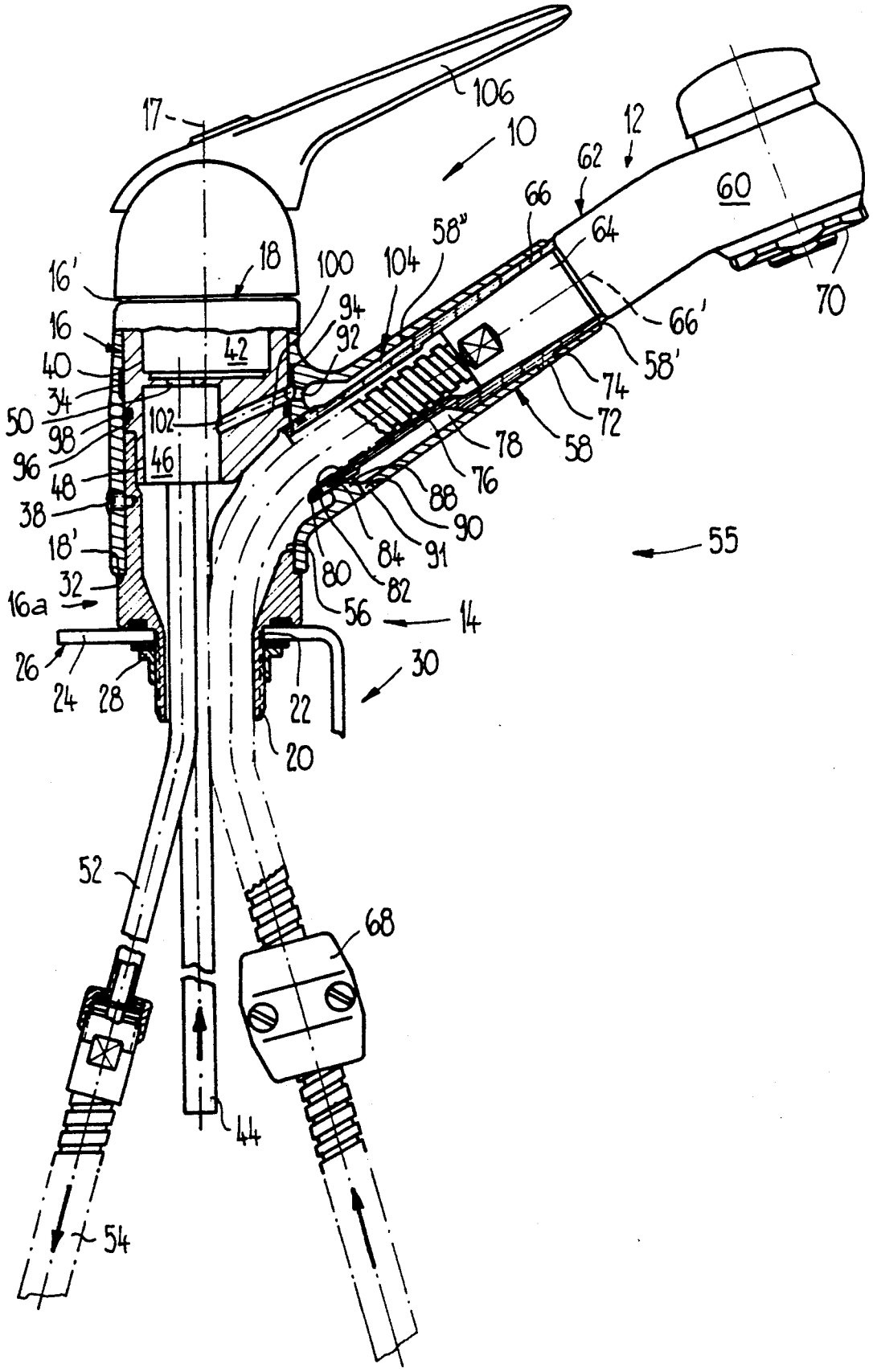
106
17
10
12
62
60
66
64
58"
18
100
104
16'
94
92
66'
70
16
42
58'
40
74
34
72
50
102
98
78
58
96
46
76
48
88
38
90
18'
84
91
55
80
32
82
16a
56
14
26
30
24
28
22
20
52
68
44
54

SANITARY FITTING

BACKGROUND OF THE INVENTION

1. Field of the Invention

The present invention relates to a sanitary fitting.

2. Discussion of the Background

There are conventional sanitary fittings in which the quality of the feed water can be endangered on re-suction of impure water into the feed line. These include, in particular, wash basin and sink fittings having a pull-out hose shower and shower and bath tap units having a hose shower. It can occur in the case of fittings of this type that the shower is lying in a basin or in a bath when, for example, the feed line breaks. If the fitting is open at that moment, the water in the basin or the bath can be completely sucked out via the shower due to the negative pressure which is built up in the feed line due to the water flowing off. Impure water can thus pass into the feed line and emerge again later after repair at the corresponding fitting or even at a different location. For this reason, fittings of this type must have safeguards, by means of which re-suction of impure water into the feed line is prevented.

Sanitary fittings having pull-out hose showers, for example produced by KWC AG, Unterkulm, Switzerland, are freely available on the market, which fittings have a nonreturn valve which is installed in the shower itself in order to prevent a backflow of impure water into the feed line. However, nonreturn valves of this type are not considered by all authorities to be sufficiently reliable since spring fractures or other types of malfunctions have to be expected. DIN 1988, part 4, dated Dec. 1988 lists safeguards which prevent undesired backflow of impure water into the feed line. Furthermore, DIN 3266, part 1, dated July 1986, describes in detail safeguards of this type, such as, for example pipe interrupters or pipe aerators. These safeguards have an aeration aperture which is closed in the case of normal outflow of water from the fitting, but is open at least under conditions permitting backflow of water in order to ventilate the outlet line for the water between the safeguard and the outlet. At the same time, the feed line is separated in terms of flow from the outlet line. It is possible under certain conditions that small amounts of leakage water may escape from the aeration aperture. This is the case, for example, if there is positive pressure in the hose portion of the hose shower when the aeration aperture of the safeguard is exposed in order to prevent backflow of impure water into the feed line. Although these quantities of leakage water are usually small, they can lead to undesirable damage and impurities. However, it should also be noted that greater quantities of water may escape from the ventilation aperture as a result of a defect.

A sink tap unit is known from DE-U-G 88 13 390.7. The one-piece fitting housing has a nozzle projecting toward the front, through which a hose portion of a hose shower is guided and into which the shower can be inserted. A safeguard for preventing the backflow of water into the feed line is installed in the control cartridge constructed as a piston mixer. The control cartridge has an aeration aperture which is closed under normal operating conditions by a rubber disk. If, in contrast, a negative pressure is built up in the feed line, the rubber washer exposes the aeration aperture in order to ventilate the feed line. The aeration aperture is connected to the surroundings by an aeration channel which is arranged in the nozzle and opens out into the interior of the nozzle in the vicinity of the free end of the nozzle. In the case of water leakage passing through the aeration aperture into the aeration channel, said water leakage runs through the interior of the nozzle and the fitting housing in an uncontrolled manner which can lead to undesirable impurities and damage. Furthermore, the hose is subjected to undesirable severe bending loads as it emerges from the nozzle if it is pulled sideways.

SUMMARY OF THE INVENTION

It is therefore an object of the present invention to provide a fitting of a generic type which prevents uncontrollable impurities in the case of any escape of water leakage from the safeguard into the aeration channel and, at the same time, allows swiveling of the nozzle.

This object is achieved by the features of claim 1.

According to the invention, the fitting has an aeration channel connected to an aeration aperture of a safeguard, which aeration channel opens out of the fitting housing at the front. Any water leakage escaping through the aeration aperture is thus conducted to the front of the fitting where it can flow off into a bath or a basin without causing any damage. Furthermore, it is immediately recognizable if water should escape as a result of a defect in the safeguard. Since the aeration channel is provided in the fitting itself, no adaptations or modifications are necessary either on a bath or on a basin or drain. Since the opening of the aeration channel is provided at the front of the fitting, the opening can be readily inspected in order to ensure that the opening is not blocked and thus, correct functioning of the safeguard is guaranteed. Furthermore, no separate lines have to be fed out of the fitting, which thus avoids increasing the size of the fitting housing.

The construction according to the present invention provides in a simple manner the permanent connection of the safeguard to the surroundings in a swivel fitting.

Particularly preferred embodiments of the invention are specified in further dependent claims.

BRIEF DESCRIPTION OF THE DRAWINGS

The present invention is described in detail with reference to an embodiment illustrated in the sole figure.

The sole figure shows purely diagrammatically and in a simplified form a sink fitting having a pull-out hose shower, partially in section.

DESCRIPTION OF THE PREFERRED EMBODIMENT

The sanitary fitting shown in the figure has a fitting housing 10 and a pull-out hose shower 12. The fitting housing 10 consists essentially of three parts, a lower and an upper housing part 14 and 16 respectively, these forming a fixed housing part **16*a*, and a jacket element 18 which is mounted on the housing part 16*a* so as to be swivelable about an axis 17 extending essentially in the vertical direction. The lower housing part 14 is essentially of sleeve-shaped construction and molded on to it in the lower end region is an attachment nozzle 20 which penetrates a hole 22 in an approximately horizontally extending edge 24 of a sink 26. Screwed on to the attachment nozzle 20 from below is a nut 28, by means of which the fitting is fastened to the sink 26. The sink 26 has a deeper part 30 which is indicated only diagrammatically and is arranged in front of the housing part 16***a*.

Seated on the lower housing part 14 is the upper housing part 16 which engages with its lower end region in the upper end region of the lower housing part 14 and is fixedly connected to the latter. In the region between the attachment nozzle 20 and the upper housing part 16, the lower housing part 14 has a steplike taper 32 on the outside diameter. The lower and upper housing parts 14, 16 are of cylindrical construction, being concentric relative to the axis 17 and having the same diameter from the taper 32 upward to the upper end 16' of the upper housing part 16. The corresponding cylindrical jacket surface is denoted as 34.

In the region of the jacket surface 34, the upper and lower housing parts 14, 16 are overlapped by the hollow cylindrical jacket element 18 which is supported with its lower end 18' on the taper 32. At the rear side 35, the lower housing part 14 has a boundary groove 36 extending in the circumferential direction, in which a guide bolt 38 engages which is screwed into the jacket element 18 from the rear. The boundary groove 36 extends in relation to the plane of the drawing in both directions of rotation about the axis 17, for example by 60° in each case, by which means the swivel angle of the jacket element 18 is restricted to 120° in relation to the fixed housing part 16*a*. Furthermore, the jacket element 18 is fastened in a stationary manner in relation to the lower housing part 16*a* in the direction of the axis 17 by the guiding action of the guide bolt 38 in the boundary groove 36.

The upper housing part 16 has a cylindrical recess 40 which is open toward the top and has the form of a blind hole, in which recess a control cartridge 42, indicated only diagrammatically, is inserted. The control cartridge 42 is a single-lever mixing valve, such as is generally known and is described in detail, for example in the Swiss Patent Specifications 651,119 or 654,088. On the inlet side, the control cartridge 42 is connected in each case to a feed line 44 for cold and hot water, only one of the two feed lines 44 being shown in the figure. The feed lines 44 are guided from below through the attachment nozzle 20 and the lower housing part 14 and opened out into a bore hole (not illustrated) which connects the feed lines 44 to the control cartridge 42. Connected downstream from the control cartridge 42 is a safeguard 46, indicated only diagrammatically, which is inserted in a further recess 48 in the upper housing part 16, which recess is open toward the lower housing part 14 and has the form of a blind hole. Provided between the recess 40 and the further recess 48 is a passage aperture 50 which connects the control cartridge 42 in terms of flow to the safeguard 46 on the outlet side. Guided away from the safeguard 46 in the direction of the axis 17 toward the bottom is a pipe 52 which is guided through the attachment nozzle 20 below the sink 26. This end of the pipe 52 is connected to a flexible hose 54 of the hose shower 20, which hose is guided with the other end region through the attachment nozzle 20 again forming a supply loop below the sink 26. At the front 55, the lower housing part 14 has an aperture 56 extending approximately in the radial direction, through which aperture this end region of the hose 54 is guided into a nozzle 58 which is molded on to the jacket element 18 and projects forward from said jacket element and obliquely upward. The hose 54 opens out into a shower 60, the handle 62 of which is inserted with the hose-side end region 64 in a guide sleeve 66 arranged in the nozzle 58 in a manner such that it can be pulled out again. Below the sink 26, a weight 68 is attached to the hose 54, which weight pulls the hose 54 back when the pulled-out hose shower 12 is pushed back. For reasons of completeness it should be mentioned that the hose 54 has a flexible metallic jacket and an inner hose part, which is not shown but which is generally known, made of rubber-elastic material or of plastic. The outlet of the hose shower 12 is denoted as 70. Of course, the aperture 56 is of such a size in a circumferential direction that swiveling of the jacket element 18 by the nozzle 58 within the swivel range determined by the boundary groove 36 is possible without any problems arising.

The essentially hollow-cylindrical guide sleeve 66 is fastened in a stationary manner in the form of a snap-on connection by means of a catch 72 which engages in a hole 74 in the nozzle 58. As seen from the free end 58' of the nozzle 58, the guide sleeve 66 rests approximately over half the length of the nozzle 58 on its inner wall 58''. From a point at approximately the center of the nozzle 58 up to the lower end region, the guide sleeve 66 has a portion 76 with a reduced outside diameter, which portion 76, together with the inner wall 58'' bounds a jacket space 78. Molded on to the guide sleeve 66 in the lower end region is a circumferential elevation 80, out of which a circumferential groove 82 is formed, in which groove a sealing ring 84 is inserted. In the region of the elevation 80, the nozzle 58 has an inwardly projecting thickened portion 88 which overlaps the nozzle and on which the sealing ring 84 rests along its circumference. The sealing ring 84 thus seals off the lower-lying end of the jacket space 78. The lower end of the guide sleeve 66 is aligned approximately with the jacket surface 34 of the fixed housing part 16*a*. From the lowest point of the jacket space 78, a passage 90 extends through the wall of the nozzle 58. The opening 91 of this passage 90 is thus provided at the front of the fitting and is situated above the deeper part 30 of the sink 26.

In relation to the longitudinal axis 66' of the guide sleeve 66, which axis coincides approximately with the longitudinal axis of the nozzle 58, approximately diametrically opposite the passage 90 an aeration passage 92 is provided through the thickened portion 88 extending approximately in the radial direction in relation to the axis 17, which aeration passage connects the jacket space 78 in terms of flow to an annular channel 94. The annular channel 94 is worked into the jacket element 18 and extends on its inside, as seen in a radial direction, in the circumferential direction around the upper housing part 16 and is bounded on this side by the housing part. Provided in the upper housing part 16 below the annular channel 94 is a circumferential groove 96, in which a further sealing ring 98 is placed which rests with its circumference on the jacket element and seals off the lower-lying end of the annular channel 94. The annular channel 94 is connected in terms of flow to the safeguard 46 by means of an aeration line 100 which is worked into the upper housing part 16 and opens out into the further recess 48.

The safeguard 46 itself can be of different construction. For example, it can have a pipe interrupter, model A2 in accordance with DIN 3266, part 1, dated July 1986. However, a safeguard combination can also be provided having a backflow preventer and a pipe aerator in accordance with DIN 1988, part 4, dated Dec. 1988, and DIN 3266, part 1, dated July 1986. Other models of the safeguard, such as, for example, pipe disconnecters, are also conceivable. A pipe interrupter model A2 has, for example, a nozzle which is closed at its end and which engage with spacing in a pipe element which is coaxial in relation to said nozzle. Radial throughflow apertures are provided on the nozzle for the water and the pipe has a plurality of radial aeration apertures for the air inlet. An elastic, hollow-cylindrical closing member rests on the nozzle when the throughflow of water is interrupted and closes its throughflow apertures which thereby expose the aeration apertures. As soon as there is positive pressure in the nozzle, the closing member is pressed radially outward while exposing the throughflow apertures so that the throughflow of water is released by the pipe interrupter and the air supply through the aeration apertures is blocked.

In any case, the safeguard 46 has a diagrammatically indicated aeration aperture 102 which is connected in terms of flow to the aeration line 100, but is otherwise sealed off toward the outside. The aeration line 100, the annular channel 94, the aeration passage 92, the jacket space 78 and the passage 90 form an aeration channel 104 which connects the aeration aperture 102 of the safeguard 46 to the surroundings. The aeration channel 104 extends inside the fitting housing 10 and opens out from the fitting housing 10 on the front 55 of the fitting housing 10 over the deeper part 30 of the sink 26.

The control cartridge 42 inserted in the upper housing part 16 has a one-arm operating lever 106. By rotation of the operating lever 106 about the axis 17, the quantities of throughflow for the hot and cold water are changed in the same way in the control cartridge 42, by which means the temperature of the water flowing out of the control cartridge 42 can be adjusted. Furthermore, the operating lever 106 can be swivelled about a horizontal axis, by which means the quantity of water flowing through the fitting can be regulated or interrupted.

The basic mode of operation of the safeguard 46 is described in DIN 3266 dated July 1986 and DIN 1988 dated Dec. 1988. In the case of water flowing normally through the fitting, the aeration aperture 102 is closed so that no water can escape through the latter into the aeration channel 104. If, in contrast, conditions prevail which permit backflow of water into the feed line 44, the safeguard 46 must stop the backflow of water through the passage aperture 50 into the opened control cartridge 42 and back into the feed line 44 and, at the same time, open the aeration aperture 102 in order to aerate the pipe 52 and the hose 54. The air for aeration can thereby pass to the safeguard 46 through the aeration channel 104 from the surroundings. On the other hand, it is also possible for water stored, for example, in the hose 54 to escape from the aperture 102 as a result of the aeration aperture 102 being opened. This water then flows through the aeration channel 104 to the opening 91 of the passage 90 at the front 55 of the fitting where it runs directly into the deeper part 30 in the sink 26. Under normal conditions, no water or only a small amount of water should run out of the aeration channel 104 in each case. Nevertheless, if a permanent flow of water is recognizable, it can be assumed that the safeguard 46 is defective.

The embodiment of the aeration channel 104 having an annular channel 94 shown in the figure and described above permits trouble free guiding of any leakage water escaping from the aeration aperture 102 independent of the swivel position of the jacket element 108 in relation to the upper housing part 16. A corresponding embodiment of the aeration channel 104 is thus also conceivable for fittings, in which the jacket element 18 can be rotated by 360° about the axis 17. Furthermore, it should be noted that the proposed fitting does not require any additional line guided through the attachment nozzle 20, which permits a customary construction of the attachment nozzle.

It is, of course, also conceivable for the aeration channel to be of a different construction. For example, it would be possible to guide the flow channel inside the fitting housing 10 from the upper housing part 16 through the lower housing part 14 and laterally out of the latter, a pipe piece then being connected to the lower housing part 14, which pipe piece, in turn, ends in the region of the front of the fitting.

What is claimed as new and desired to be secured by lettes patent of the United States is:

1. A sanitary fitting which comprises:

a fitting housing having a front portion;

a nozzle projecting substantially toward the front portion of the housing and having an outlet line extending through the nozzle to an outlet;

a control cartridge positioned in the fitting housing and connected on an inlet side to at least one feed line for controlling water flow from the control cartridge through said outlet line;

safeguard means provide din the fitting housing for preventing backflow of water into the feed line with an aeration aperture formed therein which is closed in the case of normal outflow and open under conditions permitting backflow;

aeration channel means for connecting said aeration aperture to surroundings and said aeration channel means opening out from said fitting housing on the front;

the fitting housing having a first, fixed housing part and a second, swivelable housing part including the nozzle and being mounted on said fixed housing part;

the control cartridge and the safeguard being arranged in the fixed housing part;

the aeration channel means including an aeration line, a channel and a channel element;

said channel being bounded jointly by the fixed housing part and by the swivelable housing part and extending substantially in a swivel direction of the swivelable housing part; and said channel being connected via said aeration line provided in the fixed housing part with said aeration aperture and to surroundings via said channel element provided in the swivelable housing part.

2. The fitting as claimed in claim 1, wherein at least a portion of said fitting housing is arranged above a basin and the aeration channel means is provided with an opening on an underside portion of the nozzle and comes to rest over a deeper part of the basin.

3. The fitting as claimed in claim 1, which comprises:

a pullout hose shower having a hose which is guided through the nozzle;

a guide sleeve provided in the nozzle to fasten the shower therein, wherein the guide sleeve and an inner wall of the nozzle forms an annular jacket space which is communicated with the channel by means of an aeration passage extending inside the swivelable housing part and with the surroundings by means of a passage formed through the nozzle.

4. The fitting as claimed in claim 1, wherein the swivelable housing part has a substantially cylindrical jacket element which overlaps the fixed housing part and the nozzle projects therefrom, and wherein the channel is formed annularly extending around the fixed housing part.

5. The fitting as claimed in claim 3, wherein the jacket space is constructed so as to be watertight at a lower-lying end thereof.

6. The fitting as claimed in claim 5, which comprises a sealing ring positioned below the jacket space between the guide sleeve and the nozzle.

7. The fitting as claimed in claim 1, wherein the safeguard means is connected downstream from the control cartridge and, under conditions permitting backflow, includes means for aerating the outlet line connecting the safeguard to the outlet.

8. The fitting as claimed in claim 1, wherein the safeguard includes one of a pipe interrupter and a combination of a backflow preventer and pipe aerator.

9. The fitting as claimed in claim 4, wherein the channel is constructed so as to be watertight at a lower-lying end thereof.

10. The fitting as claimed in claim 4, which comprises a sealing ring positioned below the channel between the fixed housing part and the jacket element.

11. The fitting as claimed in claim 1, wherein the aeration channel means opens out from said fitting housing in a region of the nozzle.

12. The fitting as claimed in claim 1, wherein a channel is constructed so as to be watertight at a lower-lying end thereof.

* * * * *